US010861661B2

(12) United States Patent
Kupka et al.

(10) Patent No.: US 10,861,661 B2
(45) Date of Patent: Dec. 8, 2020

(54) CONTACT PIN FOR AN ELECTRIC SWITCH, ELECTRIC SWITCH WITH SAID TYPE OF CONTACT PIN AND METHOD FOR PRODUCING SAID TYPE OF CONTACT PIN

(71) Applicant: Siemens Aktiengesellschaft, Munich (DE)

(72) Inventors: Daniel Kupka, Amberg (DE); Michael Aicher, Amberg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 16/475,422

(22) PCT Filed: Dec. 18, 2017

(86) PCT No.: PCT/EP2017/083322

§ 371 (c)(1),
(2) Date: Jul. 2, 2019

(87) PCT Pub. No.: WO2018/130382

PCT Pub. Date: Jul. 19, 2018

(65) Prior Publication Data

US 2019/0341207 A1 Nov. 7, 2019

(30) Foreign Application Priority Data

Jan. 10, 2017 (DE) ..... 10 2017 200 292

(51) Int. Cl.
*H01H 1/025* (2006.01)
*H01H 33/02* (2006.01)

(52) U.S. Cl.
CPC ..... *H01H 33/025* (2013.01); *H01H 1/025* (2013.01)

(58) Field of Classification Search
CPC ..... H01H 1/021; H01H 1/025; H01H 33/025; H01H 11/048; H01H 11/045; B22F 7/00; B22F 7/06; B22F 2207/01; C22C 32/0084; C22C 1/045
USPC ..... 218/146; 200/264, 269
See application file for complete search history.

(56) References Cited

U.S. PATENT DOCUMENTS 3,069,757 A 12/1962 Beggs et al.
4,689,196 A * 8/1987 Leung ..... C22C 32/0052 252/503
4,910,868 A 3/1990 Fevrier et al.
(Continued)

FOREIGN PATENT DOCUMENTS

DE 1483706 A1 4/1970
DE 1765050 A1 7/1971
(Continued)

OTHER PUBLICATIONS

International Search Report PCT/ISA/210 for International Application No. PCT/EP2017/083322 dated Jun. 4, 2018.
(Continued)

*Primary Examiner* — William A Bolton
(74) *Attorney, Agent, or Firm* — Harness, Dickey & Pierce, P.L.C.

(57) ABSTRACT

An embodiment of the invention relates to a contact pin for an electric switch. The contact pin is designed as a composite support.

17 Claims, 7 Drawing Sheets

(56) References Cited

U.S. PATENT DOCUMENTS

| | | | | |
|---|---|---|---|---|
| 6,396,369 | B1 * | 5/2002 | Schlitz | H01H 1/205 218/22 |
| 6,638,334 | B2 * | 10/2003 | Nakamura | C22C 1/0466 200/266 |
| 2015/0048054 | A1 * | 2/2015 | Karkada | H01H 1/0233 218/146 |
| 2015/0069020 | A1 * | 3/2015 | Steinwandel | H01H 33/10 218/146 |
| 2015/0083558 | A1 | 3/2015 | Malacara-Carrillo et al. | |
| 2015/0155110 | A1 * | 6/2015 | Kowanda | H01H 1/0206 200/266 |
| 2016/0141124 | A1 | 5/2016 | Pohle et al. | |
| 2016/0172140 | A1 * | 6/2016 | Eismann | H01H 1/027 200/268 |

FOREIGN PATENT DOCUMENTS

| | | | |
|---|---|---|---|
| DE | 3528890 | A1 | 2/1987 |
| DE | 68906445 | T2 | 11/1993 |
| EP | 1264908 | A1 | 12/2002 |
| GB | 1140943 | A | 1/1969 |
| WO | WO 2014202390 | A1 | 12/2014 |

OTHER PUBLICATIONS

Written Opinion of the International Searching Authority PCT/ISA/237 for International Application No. PCT/EP2017/083322 dated Jun. 4, 2018.
German Office Action dated Oct. 16, 2017.

* cited by examiner

CONTACT PIN FOR AN ELECTRIC SWITCH, ELECTRIC SWITCH WITH SAID TYPE OF CONTACT PIN AND METHOD FOR PRODUCING SAID TYPE OF CONTACT PIN

PRIORITY STATEMENT

This application is the national phase under 35 U.S.C. § 371 of PCT International Application No. PCT/EP2017/083322 which has an International filing date of Dec. 18, 2017, which designated the United States of America and which claims priority to German patent application number De 102017200292.1 filed Jan. 10, 2017, the entire contents of which are hereby incorporated herein by reference.

FIELD

Embodiments of the present invention generally relate to a contact piece for an electric switch, to an electric switch having such a contact piece and/or to a method for producing such a contact piece.

BACKGROUND

As a result of the compact design of modern low-voltage circuit-breakers, high arc loads occur at the contact points. These loads cause erosion at the contact supports or contact pieces as a result of evaporation, mechanical spraying or spatter of silver and also as a result of thermomechanical stresses. Therefore, the materials of the contact pieces must ensure that the circuit-breaker properly fulfils the switching and protection functions even after these loads.

The erosion of the contacts can be minimized by the use of erosion-resistant contact materials, such as silver-tungsten contact materials, for example.

Suitable design measures on the switching device such as, for example, short reaction or tripping times and quenching plates serve to keep short the residence time of the arc on the contact piece. Self-induced magnetic fields force the arc down from the contact pieces and thus minimize the residence time on the contact pieces and thus their loading and possible damage.

The residence time of the arc on the contact piece can additionally be reduced by applying so-called arc runners in the vicinity of the contact support in the desired arc propagation direction. The arc runners usually consist of ferromagnetic constituents such as iron or steel and support the arc movement down from the contact piece by virtue of their preventing the arc root from remaining on the edge of the contact piece.

DE 689 06 445 T2 discloses a method for producing a composite body for an electric contact, for example. The method for producing a composite contact piece composed of a carrier and a lamina comprises the following work steps:

preparing a block of precompressed, agglomerated or sintered powder of the material mentioned, preforming the carrier in order to produce a depression at the location provided for receiving the contact plate, inserting the block into the depression, inserting the carrier into an automatic resistance welding machine, and feeding a suitable current and compressing the powder block.

SUMMARY

At least one embodiment of the invention provides a contact for an electric switch which is composed of as few parts as possible and can, in at least one embodiment, be produced directly by way of a method.

At least one embodiment of the invention is directed to a contact piece for an electric switch. Advantageous configurations of the contact piece according to the invention are specified in embodiments. At least one embodiment of the invention is directed to the electric switch. Advantageous configurations of the switch according to the invention are specified in embodiments. At least one embodiment of the invention is directed to a method for producing a contact. Advantageous configurations of the method according to the invention are specified in embodiments.

The contact piece for an electric switch of an embodiment is embodied as a composite support.

What is advantageous in at least one embodiment is that it becomes possible to produce contacts with attached arc runners in a direct sintering process. Production in one step is likewise possible; the subsequent welding on for the arc runner is obviated. Besides saving the process step, this avoids thermomechanical stresses that can result in accelerated progress of damage at the contact support or the contact piece. The contact piece transitions seamlessly into the material of the arc runner, as a result of which the concentration of the electric field at the edge of the contact piece is avoided and accelerated arc dissipation is thus made possible.

The electric switch according to an embodiment of the invention comprises stationary contact and a contact arm having at least one contact piece according to an embodiment of the invention, wherein the contact arm is mounted rotatably between two positions, wherein in the first position of the contact arm the at least one stationary contact is in mechanical contact with the at least one contact piece of the contact arm for the purpose of closing the electric circuit, and wherein in the second position the at least one stationary contact is mechanically separated from the at least one contact piece of the contact arm.

The method according to an embodiment of the invention for producing a contact with a contact piece according to an embodiment of the invention comprises:

filling a cavity with the first material and the second material, wherein the first material and the second material are embodied in each case in pulverulent form;

pressing the first material and the second material in the cavity in order to form a green body;

applying the green body on the carrier;

contacting the green body with a shaping electrode and the carrier with an electrode; and feeding a current through the green body and the carrier in order to connect the green body to the carrier.

DETAILED DESCRIPTION OF THE EXAMPLE EMBODIMENTS

Figure 1:
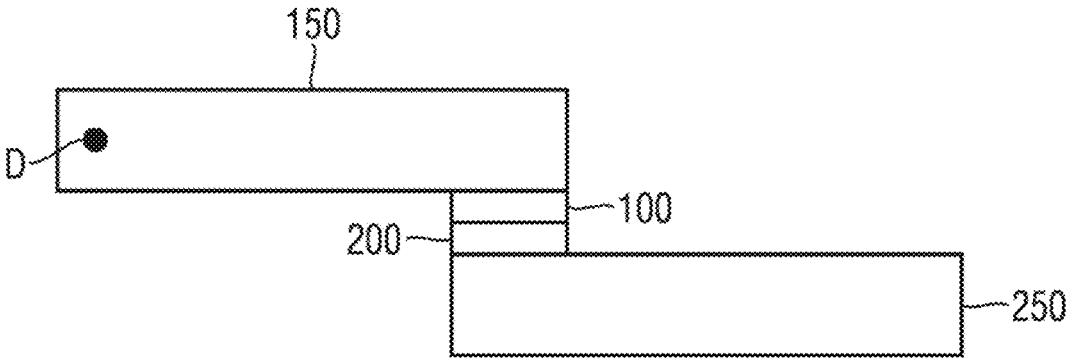
FIG. 1 shows a contact arm of an electric switch having contact piece and stationary contact in the position for closing the electric circuit.

What is advantageous in at least one embodiment is that it becomes possible to produce contacts with attached arc runners in a direct sintering process. Production in one step is likewise possible; the subsequent welding on for the arc runner is obviated. Besides saving the process step, this avoids thermomechanical stresses that can result in accelerated progress of damage at the contact support or the contact piece. The contact piece transitions seamlessly into the material of the arc runner, as a result of which the concentration of the electric field at the edge of the contact piece is avoided and accelerated arc dissipation is thus made possible.

In one configuration, the contact piece is embodied as a composite support having at least a first zone composed of a first material and a second zone composed of a second material different than the first material.

In a further configuration, a third zone is arranged between the first zone and the second zone and in the third zone the material spatially transitions from the first material gradually into the second material.

In one configuration, the first material is a contact material, for example a silver-graphite alloy.

In a further configuration, the second material comprises a sacrificial material, for example a tungsten-copper mixture.

The electric switch according to an embodiment of the invention comprises stationary contact and a contact arm having at least one contact piece according to an embodiment of the invention, wherein the contact arm is mounted rotatably between two positions, wherein in the first position of the contact arm the at least one stationary contact is in mechanical contact with the at least one contact piece of the contact arm for the purpose of closing the electric circuit, and wherein in the second position the at least one stationary contact is mechanically separated from the at least one contact piece of the contact arm.

In one configuration of an embodiment of the electric switch, the latter comprises a first stationary contact and a second stationary contact, wherein the contact arm comprises a first contact piece and a second contact piece, wherein the first stationary contact is in mechanical contact with the first contact piece of the contact arm for the purpose of closing the electric circuit, and wherein the second stationary contact is in mechanical contact with the second contact of the current arm for the purpose of closing the electric circuit.

In a further configuration of an embodiment, the first stationary contact is arranged on a first carrier and the second stationary contact is arranged on a second carrier.

The method according to an embodiment of the invention for producing a contact with a contact piece according to an embodiment of the invention comprises:

filling a cavity with the first material and the second material, wherein the first material and the second material are embodied in each case in pulverulent form;

pressing the first material and the second material in the cavity in order to form a green body;

applying the green body on the carrier;

contacting the green body with a shaping electrode and the carrier with an electrode; and feeding a current through the green body and the carrier in order to connect the green body to the carrier.

In one configuration of the method according to an embodiment of the invention, in the process of filling the cavity, the first material is separated from the second material by way of a barrier, such that the first zone comprising the first material and the second zone comprising the second material arise, wherein the barrier is removed before the pressing.

In one configuration of the method according to an embodiment of the invention, in the process of filling the cavity, the first material is introduced in a plurality of intermediate layers having a varying composition.

The above-described properties, features and advantages of this invention and the way in which they are achieved will become clearer and more clearly understood in association with the following description of the example embodiments which are explained in greater detail in association with the figures.

FIG. 1 illustrates a contact arm 150 of an electric switch 500 for opening or closing an electric circuit. The contact arm 150 comprises a contact piece 100. The contact arm 150 is pivotable about a pivot D between a position for opening the electric circuit and a position for closing the electric circuit. The contact arm 150 having the contact piece 100 can interact with a stationary contact 200. The stationary contact 200 can be arranged on a carrier 250. In the position for closing the electric circuit, the stationary contact 200 on the carrier 250 is in mechanical contact with the contact piece 100 of the contact arm 150. FIG. 1 shows this position for closing the electric circuit of contact arm 150 and stationary contact 200.

The contact piece 100 and/or the stationary contact 200 are/is embodied as a composite support.

Figure 2:
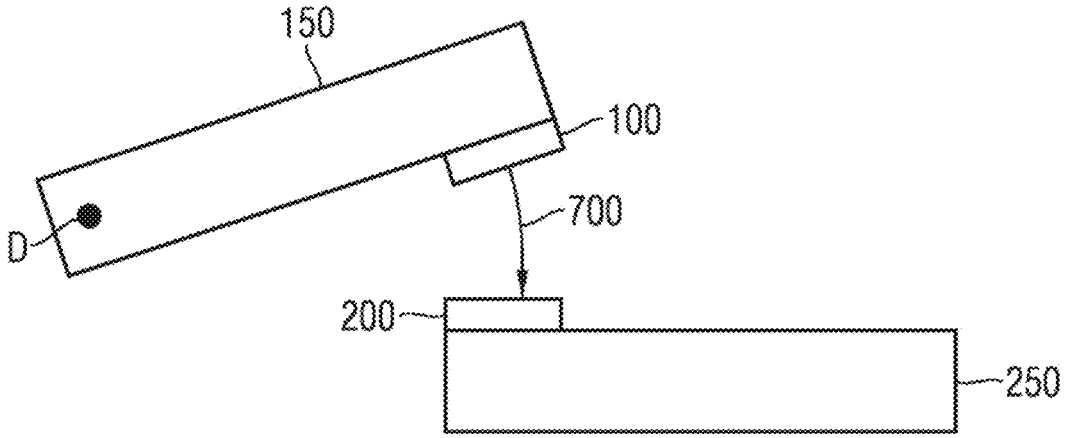
FIG. 2 shows a contact arm of an electric switch having contact piece and stationary contact in the position for opening the electric circuit.

FIG. 2 illustrates the contact arm 150 of an electric switch 500 having the contact piece 100 and the stationary contact 200 on the carrier 250 in a position for opening the electric circuit. For this purpose, the contact carrier 150 together with the at least one contact piece 100 is pivoted about the pivot D into a position for opening the electric circuit. In the position for opening the electric circuit, the contact piece 100 of the contact arm 150 is mechanically separated from the stationary contact 200 on the carrier 250. During the pivoting of the contact arm 150 into the position for opening the electric circuit, the contact piece 100 describes the part of a circular path.

During the opening of the electric circuit, that is to say the pivoting of the contact arm 150 in accordance with the illustration in FIG. 2 in the counterclockwise direction under current flow, an arc 700 arises. This arc results in loading of the contact piece 100 and of the stationary contact 200 as a result of erosion such as evaporation, mechanical spraying or spatter of silver and also as a result of thermomechanical stresses.

Figure 3:
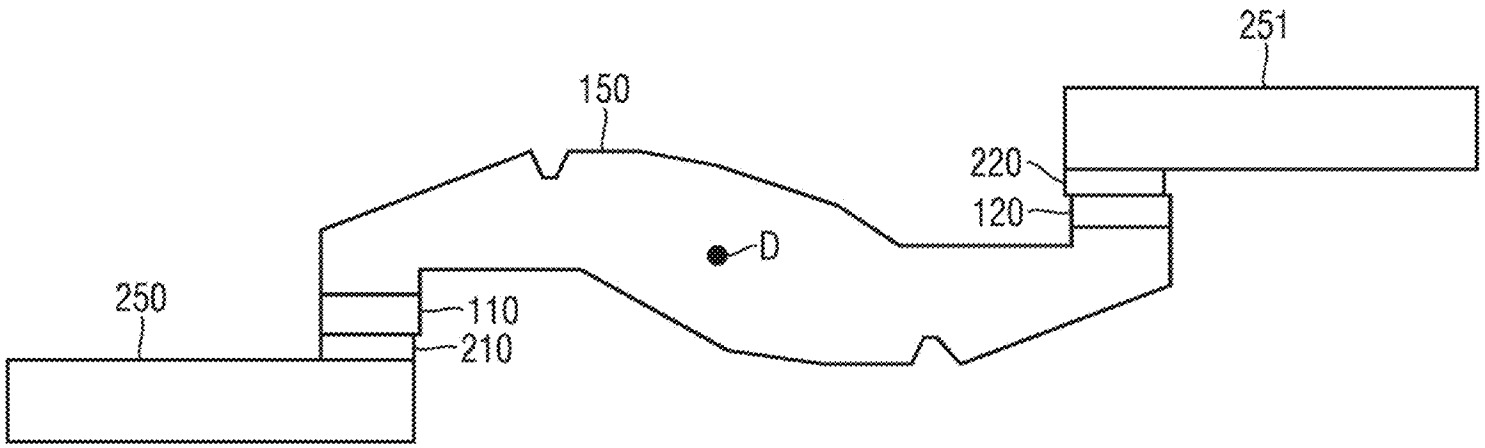
FIG. 3 shows a contact arm having two contact pieces and two stationary contacts in the position for closing the electric circuit.

FIG. 3 illustrates a contact arm 150 having a first contact piece 110 and a second contact piece 120. In addition, a first stationary contact 210 is arranged on a first carrier 250 and a second stationary contact 220 is arranged on a second carrier 251. The contact arm 150 in accordance with FIG. 3 is also called a double-break interrupter since two contact pieces 110, 120 exist per contact arm 150, the contact pieces interacting with two stationary contacts 210, 220 for the purpose of opening or closing an electric circuit. The contact carrier 150 is pivotable about a pivot D between a position for opening the electric circuit and a position for closing the electric circuit.

In accordance with the illustration in FIG. 3, the contact arm 150 is in the position for closing the electric circuit. For this purpose, the first stationary contact 210 is in mechanical contact with the first contact piece 110 of the contact arm 150 and the second stationary contact 220 is in mechanical contact with the second contact piece 120 of the contact arm 150.

Figure 4:
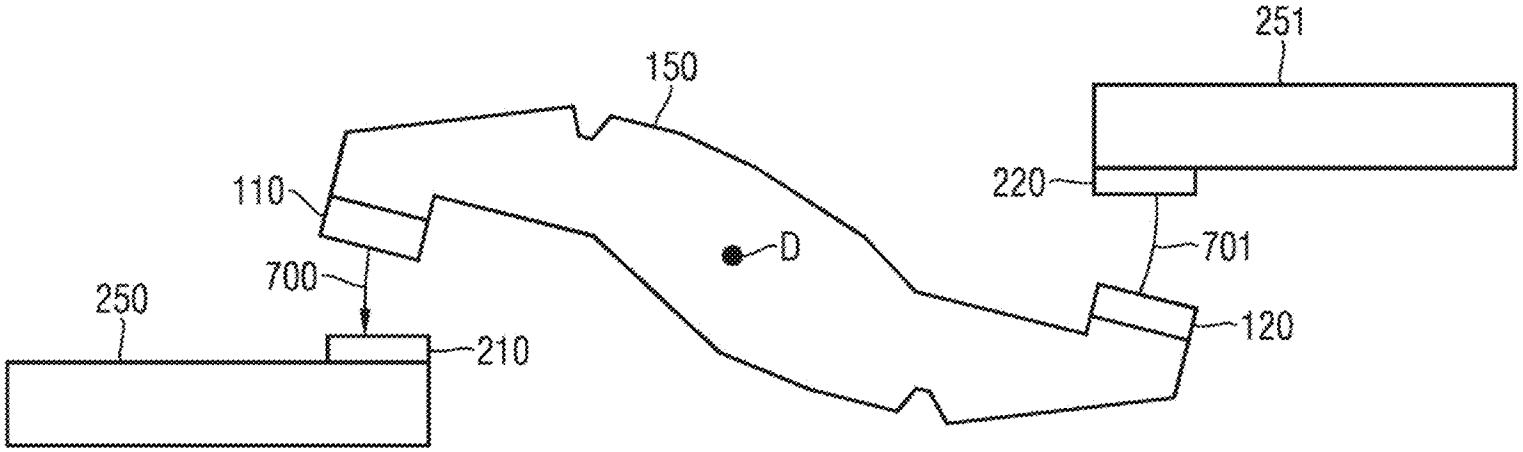
FIG. 4 shows a contact carrier having two contact pieces and two stationary contacts in the position for opening the electric circuit.

FIG. 4 illustrates the contact arm 150 and the two stationary contacts 210, 220 in a position for opening the electric circuit. For this purpose, the contact arm 150 is pivoted about the pivot D into a position for opening the electric circuit. The electric circuit is opened by the contact pieces 110, 120 of the contact arm 150 being mechanically separated from the stationary contacts 210, 220. The contact pieces 110, 120 describe the part of a circular path during pivoting. If the pivoting takes place under current flow, then arcs 700, 701 arise between the stationary contacts 210, 220 and the contact pieces 110, 120.

Figure 5A:
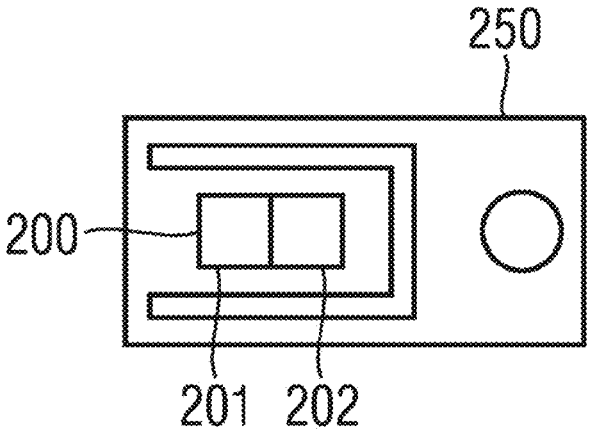
FIGS. 5A and 5B show a contact piece as a composite support and a conventional contact piece with arc runner.

FIG. 5A illustrates a contact piece 200 according to an embodiment of the invention on a carrier 250. The contact piece 200 according to an embodiment of the invention, which is embodied as a composite support, comprises a first zone 201 composed of a first material and a second zone 202 composed of a second material different than the first material. By way of example, the first material can comprise a silver-graphite alloy and serve to interact in electric contact with the contact piece 100 of a contact arm 150 for the purpose of opening or closing an electric circuit. The second zone 202 comprising the second material can be a tungsten-copper mixture, for example. This zone can serve for use as an arc runner.

Figure 5B:
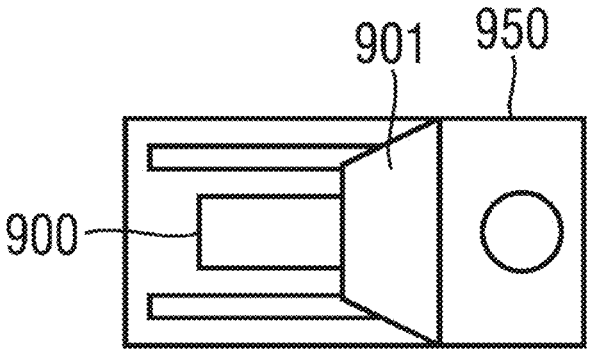

FIG. 5B illustrates a conventional contact piece 900 on a carrier 950 with an arc runner 901. In this case, two components have to be applied on the carrier 950, namely the conventional contact piece 900 and the arc runner 901.

Figure 6A:
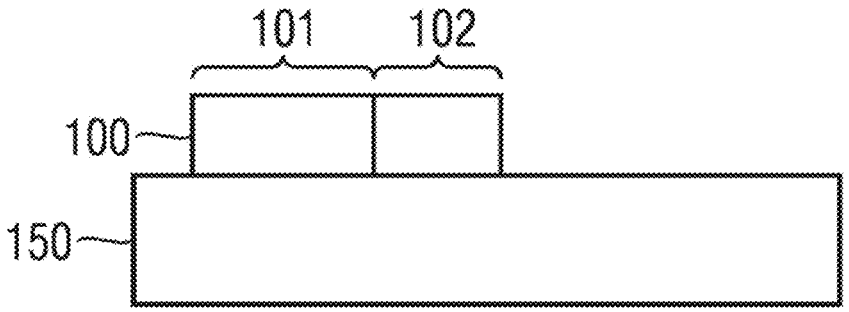
FIGS. 6A and 6B show a contact piece as a composite support having a first and a second zone and a contact piece as a composite support having a third zone between the first zone and the second zone.
Figure 6B:
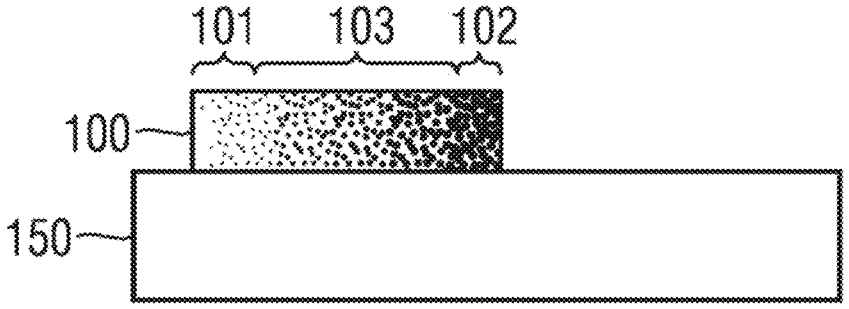

In FIGS. 6A and 6B, a respective contact piece 100 according to an embodiment of the invention is arranged on a contact arm 150 and a carrier, respectively. In accordance with FIG. 6A, the contact piece 100 as a composite support comprises a first zone 101 comprising a first material and a second zone 102 comprising a second material different than the first material. By way of example, here, too, the first material can comprise a silver-graphite alloy and the second material a tungsten-copper mixture.

FIG. 6B shows a further example embodiment of the contact piece 100 according to an embodiment of the invention. A third zone 103 is arranged between the first zone 101 composed of a first material and the second zone 102 composed of a second material, the material of the third zone spatially transitioning from the first material gradually into the second material. In accordance with the illustration in FIG. 6B, this means that the first material corresponding to the material of the first zone 101 is present at the left-hand edge of the third zone 103 and the second material of the second zone 102 is present at the right-hand edge of the third zone 103. Between these two edges a gradient extends spatially gradually from the first material to the second material.

Figure 7:
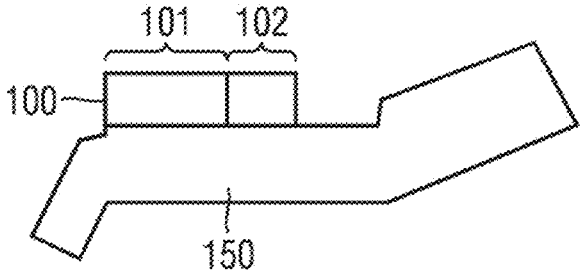
FIG. 7 shows a contact piece as a composite support having a first zone and a second zone.

FIG. 7 once again illustrates a contact piece 100 according to an embodiment of the invention as a composite support having a first zone 101 and a second zone 102. The contact piece 100 is applied on a carrier 150.

Figure 8:
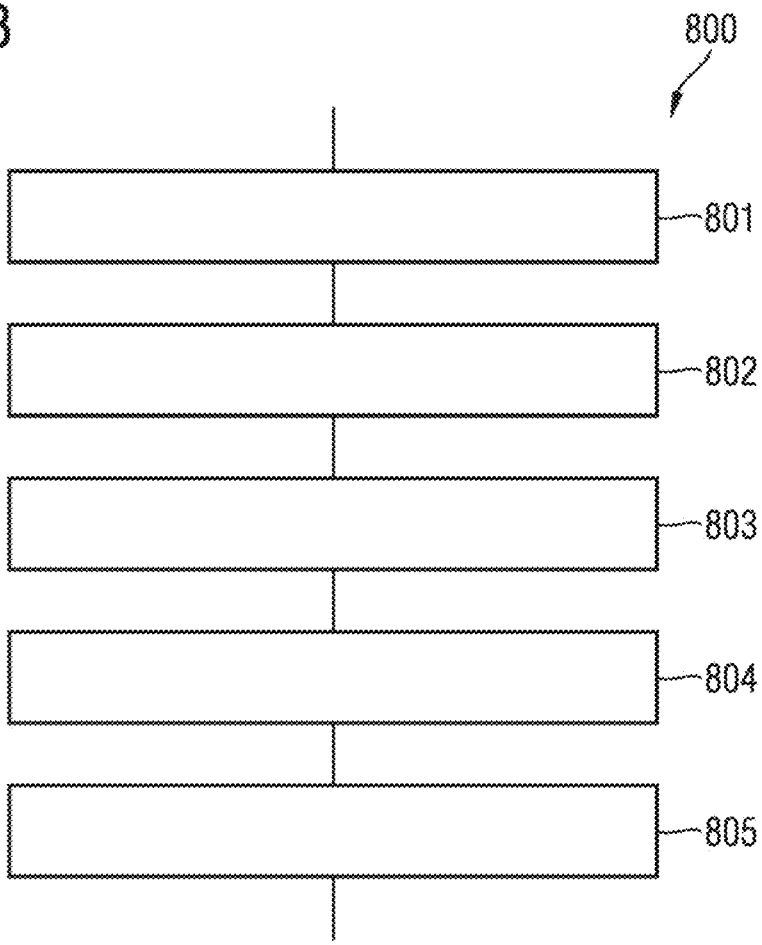
FIG. 8 shows a method for producing a contact piece.
Figure 9:
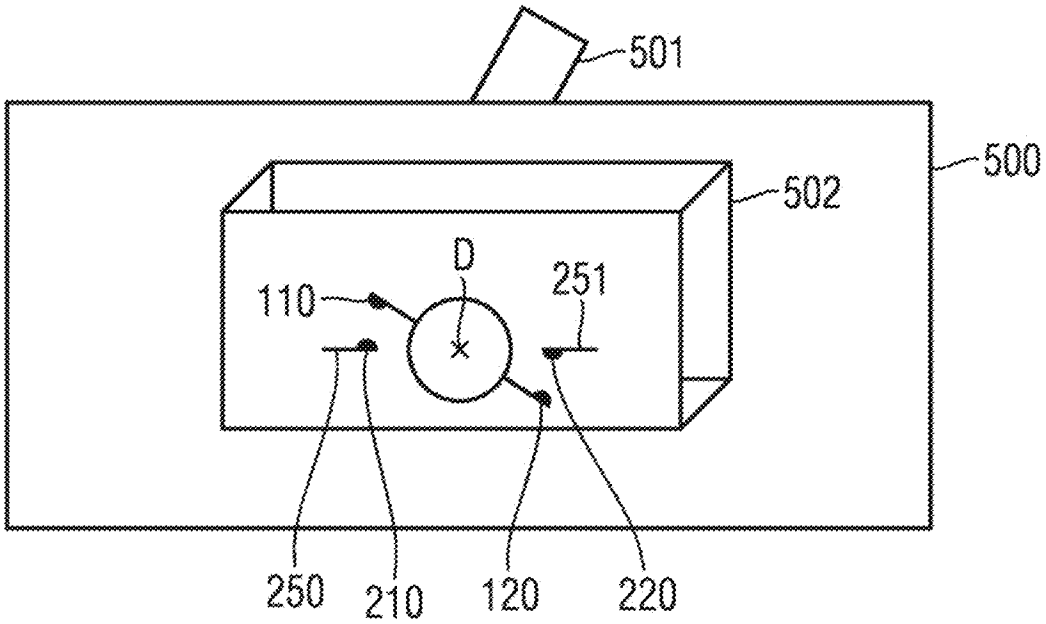
FIG. 9 shows an electric switch having a contact arm having contact pieces and stationary contacts.

FIG. 8 shows a method 800 for producing a contact with a contact piece 100, 110, 120; 200, 210, 220 according to an embodiment of the invention and a carrier 150; 250, 251, comprising:

filling 801 a cavity with the first material and the second material, wherein the first material and the second material are embodied in each case in pulverulent form;

pressing 802 the first material and the second material in the cavity in order to form a green body;

applying 803 the green body on the carrier 150; 250, 251;

contacting 804 the green body with a shaping electrode and the carrier 150; 250, 251 with an electrode; and feeding 805 a current through the green body and the carrier 150; 250, 251 in order to connect the green body to the carrier 150; 250, 251.

Feeding 805 a current through the green body and the carrier 150; 250, 251 results in heating of green body and carrier 150; 250, 251 and thus in a connection of the two workpieces. An arc runner 901 does not have to be attached in a further additional step.

In the process of filling 801 the cavity, the first material can be separated from the second material by way of a barrier, such that the first zone 101 comprising the first material and the second zone 102 comprising the second material arise. The barrier has to be removed before the pressing 802.

The advantages afforded by a contact piece 100, 110, 120; 200, 210, 220 as a composite support are diverse. By way of example, the contact piece can be produced directly in a method 800 for producing a contact with a contact piece with an attached arc runner. In this case, the second zone 102; 202 serves as an arc runner integrated directly into the contact piece. The subsequent welding on of an arc runner 901, as is necessary in the case of a conventional contact according to FIG. 5B, is obviated.

Besides saving a process step, this avoids thermomechanical stresses that can result in an accelerated damage process of the contact piece 100, 110, 120; 200, 210, 220. The first zone 101; 201 of the contact piece transitions seamlessly into the second zone 102; 202 or gradually by way of the third zone 103, as a result of which the concentration of the electric field at the edge of the contact material is avoided and accelerated arc dissipation is thus made possible.

The invention claimed is:

1. A contact piece for an electric switch, wherein the contact piece is embodied as a composite support and includes at least a first zone composed of a first material, a second zone composed of a second material, different than the first material, and a third zone arranged between the first zone and the second zone, wherein the third zone is composed of both the first material and the second material.

2. The contact piece of claim 1, wherein the first material comprises a contact material.

3. The contact piece of claim 2, wherein the second material comprises a sacrificial material.

4. The contact piece of claim 3, wherein the second material comprises a tungsten-copper mixture.

5. The contact piece of claim 2, wherein the contact material is a silver-graphite alloy.

6. The contact piece of claim 1, wherein the second material comprises a sacrificial material.

7. The contact piece of claim 6, wherein the second material comprises a tungsten-copper mixture.

8. The contact piece of claim 1, wherein material in the first zone does not include the second material, the material in the second zone does not include the first material and wherein the material in the third zone transitions from the first material to the second material.

9. An electric switch, comprising:

at least one stationary contact; and a contact arm including at least one contact piece embodied as a composite support including at least a first zone composed of a first material and a second zone composed of a second material, different than the first material and a third zone, arranged between the first zone and the second zone, wherein the third zone includes both the first material and the second material, wherein the contact arm is mounted rotatably between two positions, wherein in a first position of the contact arm, of the two positions, the at least one stationary contact is in mechanical contact with the at least one contact piece of the contact arm for closing an electric circuit, and wherein in a second position of the contact arm, of the two positions, the at least one stationary contact is mechanically separated from the at least one contact piece of the contact arm.

10. The electric switch of claim 9, wherein the at least one stationary contact includes a first stationary contact and a second stationary contact, and wherein the at least one of the contact piece of the contact arm includes a first contact piece and a second contact piece, wherein the first stationary contact is in mechanical contact with the first contact piece of the contact arm for the closing of the electric circuit, and wherein the second stationary contact is in mechanical contact with the second contact piece of the contact arm for the closing of the electric circuit.

11. The electric switch of claim 10, wherein the first stationary contact is arranged on a first carrier and wherein the second stationary contact is arranged on a second carrier.

12. The electric switch of claim 9, wherein the at least one stationary contact includes a first stationary contact and a second stationary contact and wherein the first stationary contact is arranged on a first carrier and wherein the second stationary contact is arranged on a second carrier.

13. The electric switch of claim 9, wherein the first material comprises a contact material.

14. The electric switch of claim 13, wherein the contact material is a silver-graphite alloy.

15. The electric switch of claim 9, wherein the second material comprises a sacrificial material.

16. The electric switch of claim 15, wherein the second material comprises a tungsten-copper mixture.

17. The electric switch of claim 9, wherein material in the first zone does not include the second material, the material in the second zone does not include the first material and wherein the material in the third zone transitions from the first material to the second material.

* * * * *